US007980217B2

(12) United States Patent
Evans et al.

(10) Patent No.: US 7,980,217 B2
(45) Date of Patent: Jul. 19, 2011

(54) VALVE TRAIN OF AN INTERNAL COMBUSTION ENGINE

(75) Inventors: Matthew Evans, Warren, MI (US); Ross A. Gresley, Tega Cay, SC (US); John Stallmann, Washington, MI (US); Bogyu Kang, Troy, MI (US); Brian Lee, York, SC (US)

(73) Assignee: Schaeffler Technologies GmbH & Co. KG, Herzogenaurach (DE)

( * ) Notice: Subject to any disclaimer, the term of this patent is extended or adjusted under 35 U.S.C. 154(b) by 347 days.

(21) Appl. No.: 12/353,556

(22) Filed: Jan. 14, 2009

(65) Prior Publication Data

US 2009/0183700 A1 Jul. 23, 2009

Related U.S. Application Data

(60) Provisional application No. 61/021,999, filed on Jan. 18, 2008.

(51) Int. Cl.
*F01L 1/04* (2006.01)

(52) U.S. Cl. ..... 123/90.6; 123/90.16; 123/90.44; 29/888.1

(58) Field of Classification Search ..... 123/90.16, 123/90.27, 90.31, 90.39, 90.44, 90.6; 29/888.1
See application file for complete search history.

(56) References Cited

U.S. PATENT DOCUMENTS

| | | | | |
|---|---|---|---|---|
| 5,158,049 | A | 10/1992 | Neumann | |
| 5,239,885 | A | 8/1993 | Voigt | |
| 5,645,022 | A | 7/1997 | Yamamoto et al. | |
| 6,725,818 | B2 * | 4/2004 | Methley | 123/90.27 |
| 7,114,473 | B2 | 10/2006 | Taki | |
| 2007/0034184 | A1 | 2/2007 | Dengler | |

* cited by examiner

*Primary Examiner* — Ching Chang
(74) *Attorney, Agent, or Firm* — Volpe and Koenig, P.C.

(57) ABSTRACT

A valve train of an internal combustion engine with at least one camshaft (1) on which at least one rotatable cam (2) is arranged fixed in the axial direction, wherein a rotationally fixed connection of the at least one cam (2) with the camshaft (3) can be selectively established and released by an associated coupling-like locking device (3). So that the valve train has a compact construction and low production costs and nevertheless low wear in operation, it is provided that the locking device (3) is held within the cam (2) and has a spring-loaded, annular locking collar (12) that can move in the axial direction on the camshaft (1) and, as a counter part to the locking collar (12), locking shoes (11, 11') coupled with the cam (2), wherein, in a locking position, the locking collar (12) is pressed against the locking shoes (11, 11') by contacting, ramp-shaped boundary surfaces (19, 20) formed on the locking collar (12) and the locking shoes (11, 11'), so that radial projections (15) arranged on the locking shoes (11, 11') engage in adjacent, pocket-shaped receptacles (16) of the camshaft (2) by a radial force and, in an unlocked position, the locking collar (12) is released from the locking shoes (11, 11') by a force acting against the radial force.

15 Claims, 6 Drawing Sheets

VALVE TRAIN OF AN INTERNAL COMBUSTION ENGINE

CROSS-REFERENCE TO RELATED APPLICATIONS

This application claims the benefit of U.S. Provisional Appln. No. 61/021,999, filed Jan. 18, 2008, which is incorporated by reference herein as if fully set forth.

FIELD OF THE INVENTION

The invention relates to a valve train of an internal combustion engine with at least one camshaft on which at least one rotatable cam is arranged fixed in the axial direction, wherein by an allocated coupling-like locking device, a rotationally locked connection of the one or more cams with the camshaft can be selectively established and released.

BACKGROUND OF THE INVENTION

In internal combustion engines, variable valve controllers are used in order, on one hand, to use the available engine power as effectively as possible with respect to the development of rotational speed-dependent power and torque and, on the other hand, to adjust the idling behavior and also the fuel consumption and the exhaust-gas emissions to a favorable or low setting. This is possible by varying the valve control times and valve strokes of the gas-exchange valves or through timed deactivation of individual gas-exchange valves or entire cylinders. In particular, for internal combustion engines with many cylinders and valves, through a complete shutdown of several valves or one or more cylinders, in a partial load mode and also during idling, considerable fuel savings and a reduction in pollutant emissions can be achieved. For this purpose, for one, a switchable cam follower, i.e., switchable tappet, rocker arm, or valve lifter can be used, wherein the associated switching mechanisms are formed either in conventional ways on the cam follower or, as described, for example, in the unpublished Patent Application Nos. DE 10 2007 031 815.6 and DE 2007 040 021.9 of the applicant, are shifted at least partially toward the camshaft. Second, adjustable camshafts and also camshaft arrangements can be used with cams that can be adjusted relative to the camshaft.

For the design and implementation of a variable valve train in a vehicle, the requirements for installation space of the switchable valve train components are gaining more and more significance, because reduced space conditions are given in modern engines with typically four valves per cylinder. The problem of installation space is heightened even more by the increasing use of direct fuel-injection systems. In addition, the required switching forces for the adjustment of the valve train and for the activation of the gas-exchange valves should be as small as possible, in order to keep the wear in the valve train low. Here, a shifting of the switching function to the camshaft has proven favorable.

In U.S. Pat. No. 5,239,885, a known camshaft arrangement is described in which a rotationally fixed connection between a camshaft and a cam arranged on the camshaft fixed in the axial direction can be established and released selectively by a coupling device. The coupling device has a coupling pin extending into a radial borehole of the camshaft and loaded with a compression spring. This coupling pin is supported by the spring force in the radial direction in a recess within the cam, so that the cam is locked in rotation. Here, the coupling pin sits with a positive fit in a conical receptacle region formed in the recess. In continuation of the coupling recess, a pressure chamber is formed that can be set under pressure with a hydraulic medium by an axial pressurized medium feed to the camshaft and a connection channel.

For unlocking the cam, in the pressure chamber an oil pressure is established that acts against the spring force, by which the coupling pin is forced back as far from the recess into the camshaft borehole until relative movements between the camshaft and the cam are possible that are applied when the cam elevated section reaches the allocated cam follower during the camshaft rotation. The allocated cam follower is thus not loaded with an adjustment force, so that, as a consequence, the corresponding gas-exchange valve is not opened.

This publication further proposes, for simplifying the mechanical configuration and the processing of the cam arrangement, an inclination of the coupling relative to the camshaft axis, by which an otherwise required ventilation borehole with a closure piece in the cam reference circle is eliminated. Instead, on the reference circle of the cam there is a recess reducing its width for a simplified introduction of the coupling pin into the configuration. In addition, the compression spring is eliminated. For producing the locking position, instead, the pin is loaded hydraulically by a front-end pressure chamber and the previous pressure chamber is provided with a ventilation borehole. An unlocking position is achieved by centrifugal forces during the camshaft rotation when the hydraulic loading is eliminated and optionally secured by additional measures. Because the receptacle surfaces of the coupling pin and the recess absorb the activation forces during locking and, in the locking position, all of the relative forces generated between the cam and the camshaft, the locking arrangement is relatively susceptible to wear or requires, for a long-lasting, trouble-free function, at least relatively high manufacturing expense with small production tolerances.

Furthermore, for example, from U.S. Pat. Nos. 5,158,049, 5,645,022, US 2007/0034184, and U.S. Pat. No. 7,114,473 (DE 10 2004 036 764 A1), valve trains are known in which cams are arranged so that they can move in the axial direction on a camshaft. Through the use of different mechanisms and controls described in the noted publications, through the axial shifting of at least one cam, gas-exchange valves can be deactivated and/or loaded with different valve strokes. Such axial shifting devices indeed offer, in principle, an array of adjustment options, in particular, also with a section of several cam tracks. However, they require a relative large axial structural width that, as already mentioned, is often not available in modern internal combustion engines or that requires at least complicated structural changes to the internal combustion engine.

SUMMARY OF THE INVENTION

The invention is therefore based on the objective of providing a variable valve train of an internal combustion engine of the type noted above that has a compact construction and that is also low in terms of production costs and nevertheless exhibits low-wear operation.

The invention is based on the finding that through the use of a locking device with typical ramp-like boundary surfaces in coupling devices and through the shifting of a switching mechanism for establishing and releasing a rotationally locked connection into a cam that cannot move in the axial direction and that is arranged on a camshaft, a valve train with selective valve or cylinder shutdown is possible that can be implemented with relatively low expense with good wear properties in engines with limited installation space.

According to aspect of the invention, the invention starts from a valve train of an internal combustion engine with at least one camshaft on which at least rotatable one cam is arranged fixed in the axial direction, wherein a rotationally locked connection of the at least one cam with the camshaft can be established and released selectively by an associated, coupling-like locking device. To meet the objective, it is also provided that the locking device is held within the cam and has a spring-loaded, annular locking collar that can move in the axial direction on the camshaft and a locking shoe that is formed as a counter part to the locking collar and that is coupled with the cam, wherein, in a locking position, the locking collar is pressed against the locking shoe by ramp-like boundary surfaces formed on the locking collar and the locking shoes, wherein these boundary surfaces contact each other, so that radial projections arranged on the locking shoes engage in adjacent pocket-shaped receptacles of the camshaft by a radial force and, in an unlocking position, the locking collar is detached from the locking shoes by a force acting against the radial force.

Through this configuration, the wear on the locking boundaries surfaces is advantageously reduced. The locking mechanism is essentially integrated into the cam or into the camshaft, so that the configuration has a small axial structural width and can be implemented in an especially space-saving way in engines with limited installation space conditions. Obviously, in practice several such lockable cams are integrated in one valve train.

Consequently, for the selective rotationally fixed coupling of the shutdown cam that is supported so that it can rotate and that cannot move in the axial direction with the camshaft, the invention uses ramp-like boundary surfaces and also radial projections on lockable shoes that engage in open pockets formed on the camshaft. The inclined boundary surfaces between the locking collar and the locking shoes have the effect, during the rotation of the camshaft for an axial locking movement of the collar in the direction of the shoe, for establishing the locking state, that the projections engage with the pockets of the camshaft. By a restoring force loading the locking collar with a force and the ramp surfaces, a radial force that anchors the projections in the pockets acts inwardly. A favorable pocket depth that guarantees the reliability of the locking can be determined through test series and analyses.

Each cam on the camshaft is located, by default, in the locking state. The locking collar is here pressed by the force of the locking collar restoring force formed advantageously as a helical compression spring against the locking shoe, wherein the spring is supported on the end side facing away from the locking shoes between a stop on the locking collar and a stop on the cam. The locking collar-side stop can be formed, for example, as a shoulder piece connected integrally with the locking collar and the cam-side stop can be formed as a retaining ring supported on the inside of a cam. The cam configuration is secured in the axial direction on the camshaft. For axial securing, a securing ring sitting in a groove in the camshaft and actively connected to the cam configuration can be provided.

Three separate locking shoes advantageously form, with at least one locking projection, a locking ring that is permanently connected to the cam by crenellation-like projections that correspond and interact with crenellation-like recesses on a hollow cylindrical inner wall of the cam. The crenellation-like boundary surfaces by which the locking shoes are connected to the cam guarantee, on one hand, a secure coupling with the cam. On the other hand, radial movements of the locking projections on the locking shoes permit the realization of the locked and unlocked switching modes. A unique locking orientation of the cam with respect to the camshaft is advantageously achieved by an arrangement of the projections of the locking shoes in an asymmetric angular position relative to each other. In order to even further improve the wear properties of the locking device, several projections can be formed for each locking shoe and correspondingly, several pockets can be formed for each locking shoe on the camshaft.

For unlocking the cam, advantageously a hydraulic activation can be provided. The locking collar and the cam inner wall here bound, for example, an annular pressure chamber that can be loaded in the direction of unlocking with a pressurized medium pressure via pressurized oil by a pressurized medium supply. The pressurized medium supply can be advantageously formed by an optionally otherwise present central axial borehole of the camshaft and one or more radial connection channels to the pressure chamber.

If the cam is to be unlocked during engine operation, so that relative movements are possible in the peripheral direction between the camshaft and the cam, a hydraulic pressure that acts against the spring force loading the locking shoes is established in the pressure chamber by a corresponding activation. If a sufficient counter pressure is established, the locking collar releases from the locking shoes. Consequently, the locking projections back off in the radial direction from the pockets of the rotating camshaft and the cam is unlocked, so that the cam elevated section remains in place when the cam contact surface of the allocated cam follower is reached and does not advance past the cam follower.

For controlling the hydraulic pressure, a solenoid control valve can be provided that can be switched between a low pressure that keeps a certain pressurized medium level in the pressurized medium supply in the locking position and a switching pressure that delivers an engine oil pressure generated by an oil pump. The low pressure can be held, for example, through targeted leakage or an integrated non-return valve. As an alternative to hydraulic activation, in principle, electrical activation of the adjustment movement of the locking device is also possible.

In order to minimize the production costs and to simultaneously guarantee a long service life of the cam locking, it is advantageous to use, as much as possible, different production technologies for producing the individual components. Consequently, it is possible that the lockable cam bodies are produced in a powder-metallurgical method, the locking shoes in an embossing method or a cold-forming method, and the locking collar in a deep-drawing method. Here, the locking shoe and the locking collar are advantageously produced from a particularly wear-resistant steel, for example, 16MnCr5.

In principle, the configuration according to the invention can be used in any type of valve train with camshafts, that is, both in SOHC engines or DOHC engines and also in so-called cam-in-block engines. Here, all combinations of valve shutdown, cylinder shutdown, and cam profiled switching in a valve train are possible. While the invention can also be used in diesel engines, it is especially well suited for gasoline engines, optionally with direct gasoline injection, because in these engines, choke losses can be reduced in an especially effective way by the shutdown of cylinders, by which the efficiency of the internal combustion engine can be, in turn, significantly increased.

BRIEF DESCRIPTION OF THE DRAWINGS

The invention is explained in more detail below with reference to the accompanying drawing using an actual embodiment. Shown therein are.

DETAILED DESCRIPTION OF THE PREFERRED EMBODIMENTS

Figure 1B:
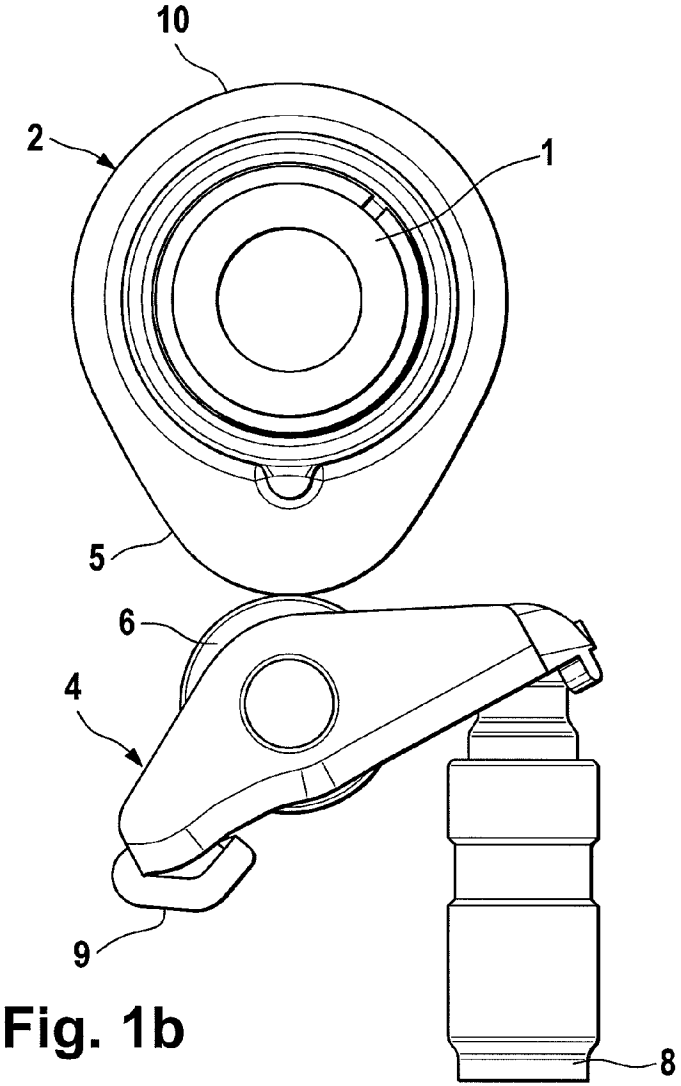
FIG. 1*b* is a top view from the front of the valve train of FIG. 1*a,*
Figure 1A:
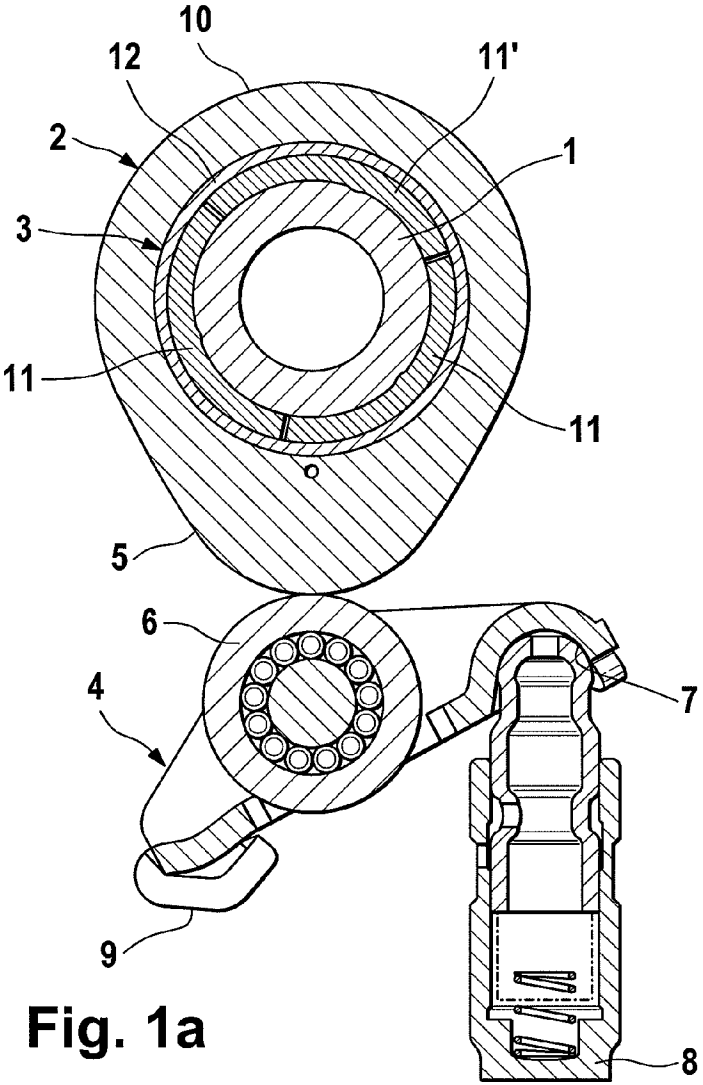
FIG. 1*a* is a cross sectional view of a valve train with a cam locking device according to the invention in locked state in a valve opening position.
Figure 2B:
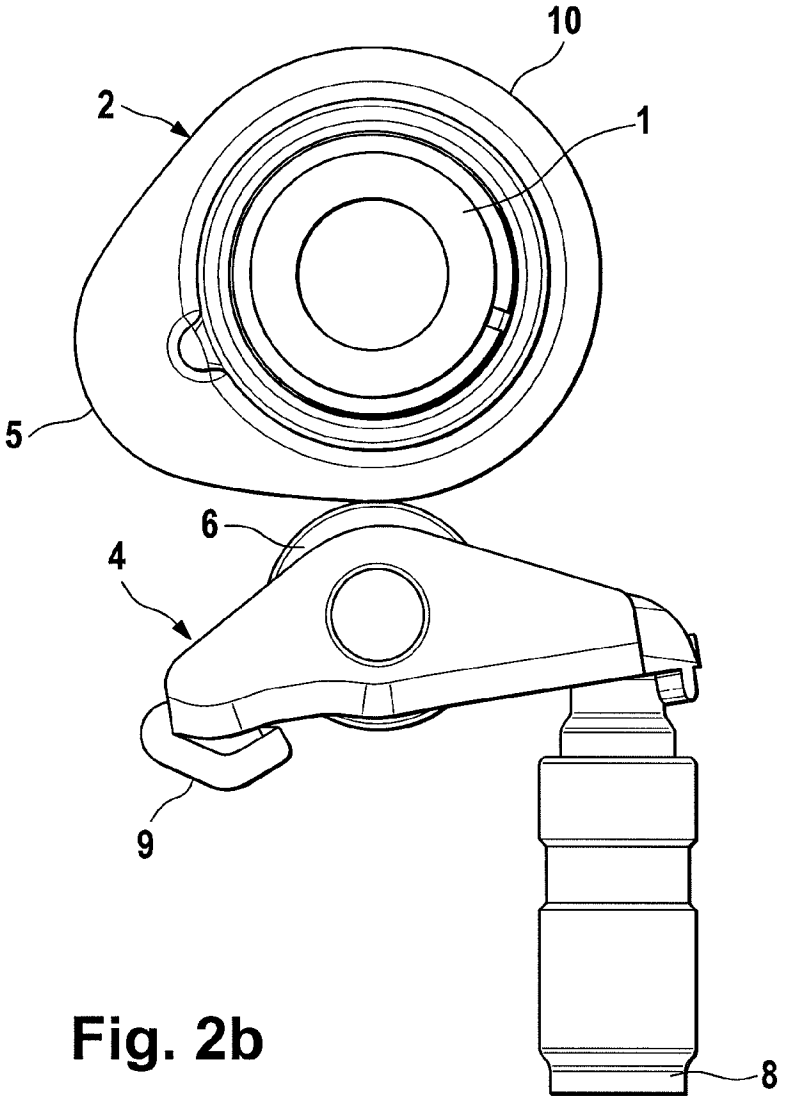
FIG. 2*b* is a top view from the front of the valve train of FIG. 2*a,*
Figure 2A:
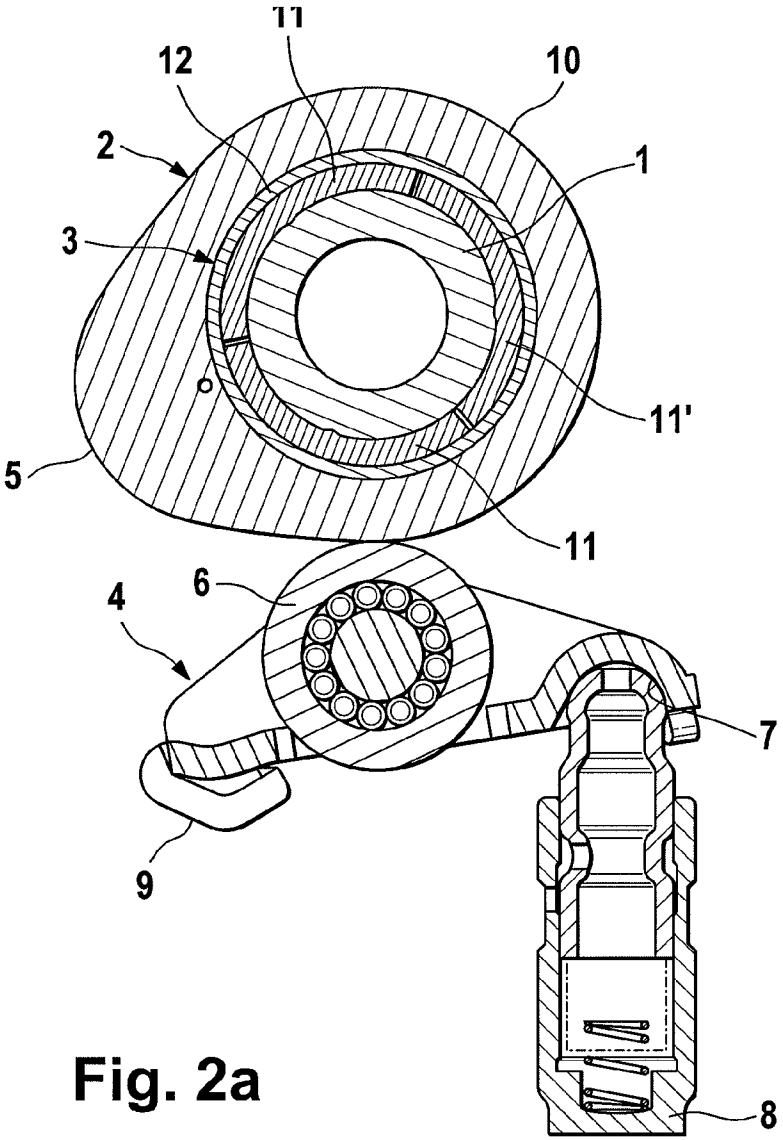
FIG. 2*a* is a cross sectional view of the valve train of FIG. 1*a* in a valve closed position.

FIGS. 1*a* and 1*b* show a valve train of an internal combustion engine of a motor vehicle in a simplified overview. A camshaft 1 is shown therein on which a cam 2 is arranged so that it can rotate but cannot move in the axial direction. The cam 2 can be selectively locked in rotation with the camshaft 1 or can be released from this camshaft by a locking device 3. The cam 2 drives a cam follower 4 formed as a roller finger lever, wherein a cam raised section 5 of the cam 2 is contacted by a contact roller 6 of the roller finger lever 4. The roller finger lever 4 has on one end a spherical cap 7 curved inwardly for receiving the movable housing of a support element 8 that is not explained in more detail. On its other end there is a contact surface 9 for at least one not-shown gas-exchange valve as an intake valve or exhaust valve of the internal combustion engine. In the activation position shown in FIGS. 1*a* and 1*b,* the contact surface 9 is pressed downward for the valve opening. For comparison, FIGS. 2*a* and 2*b* show a second cam position in which a cam reference circle 10 runs on the roller 6, that is, in a valve closed position in which the roller finger lever 4 is not pivoted.

Figure 3:
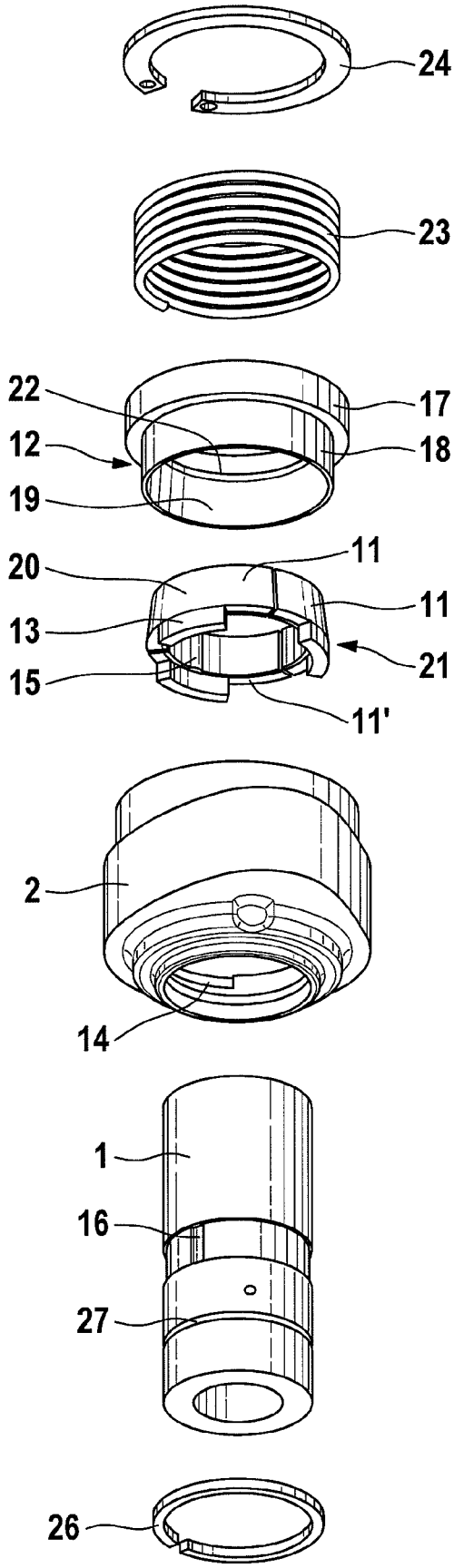
FIG. 3 is a perspective, exploded view of an assembly according to the invention with the locking device.
Figure 4A:
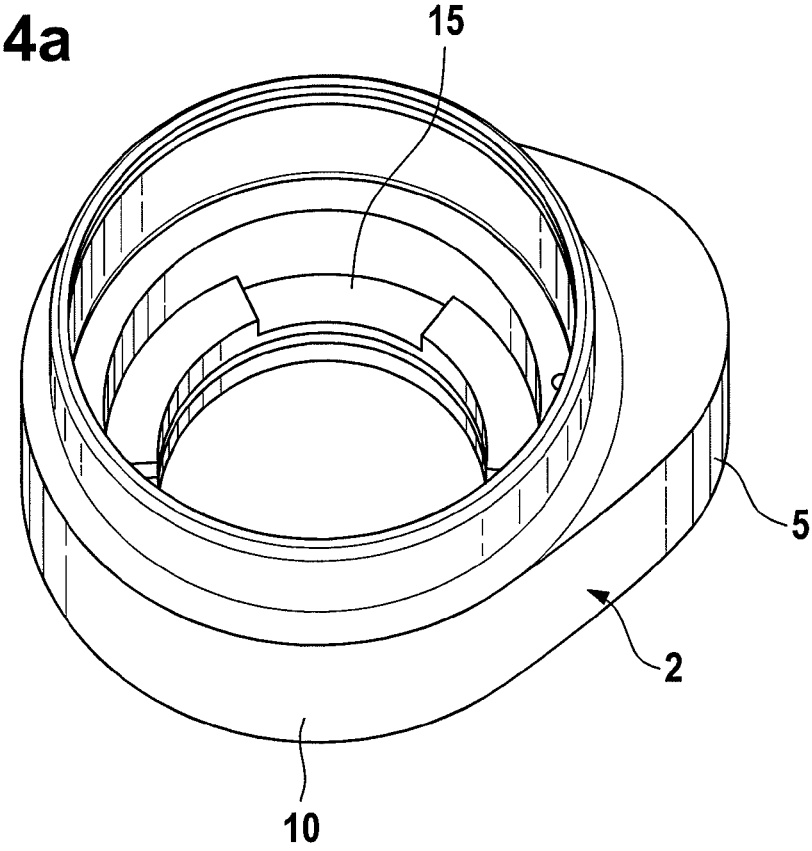
FIG. 4*a* is a perspective view of a cam according to the invention.
Figure 4B:
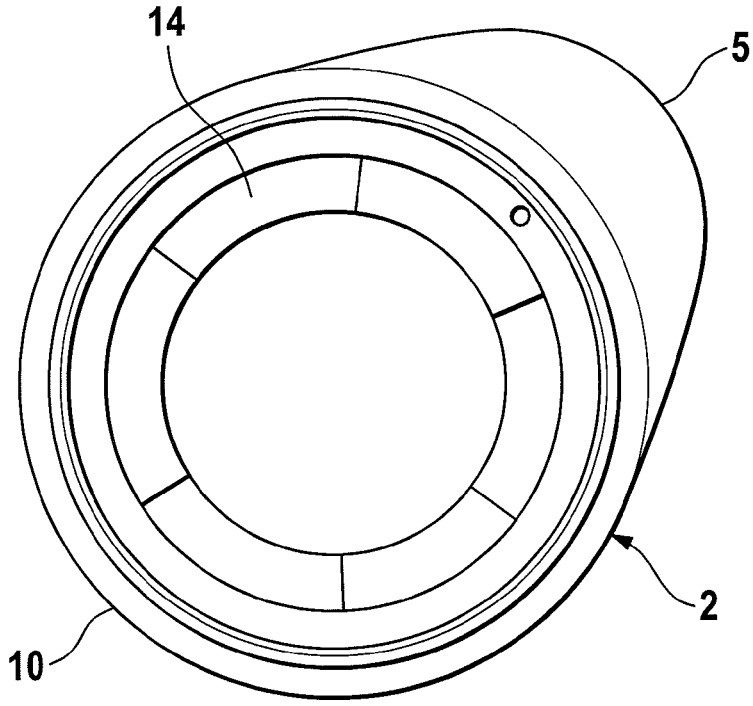
FIG. 4*b* is a cross-sectional view of the cam from FIG. 4*a,*

The individual components of the locking device 3 are shown in FIG. 3 in a representation displaced apart from each other in the axial direction. The cam 2 is formed as a hollow body for holding the locking device 3. This is essentially made from three individual locking shoes 11, 11' that form a ring 21 and also from a locking collar 12 for the radial engaging of the ring 21. An axially projecting crenellation 13 is arranged on each locking shoe 11, 11'. The cam 2 has, on its inside, a shoulder in which recesses 14 matching the crenellations 13 are cut out. The hollow body shape of the cam 2 and also the recesses 14 for holding the crenellations 13 of the locking shoes 11, 11' can be seen especially clearly in FIGS. 4*a* and 4*b.*

Figure 5A:
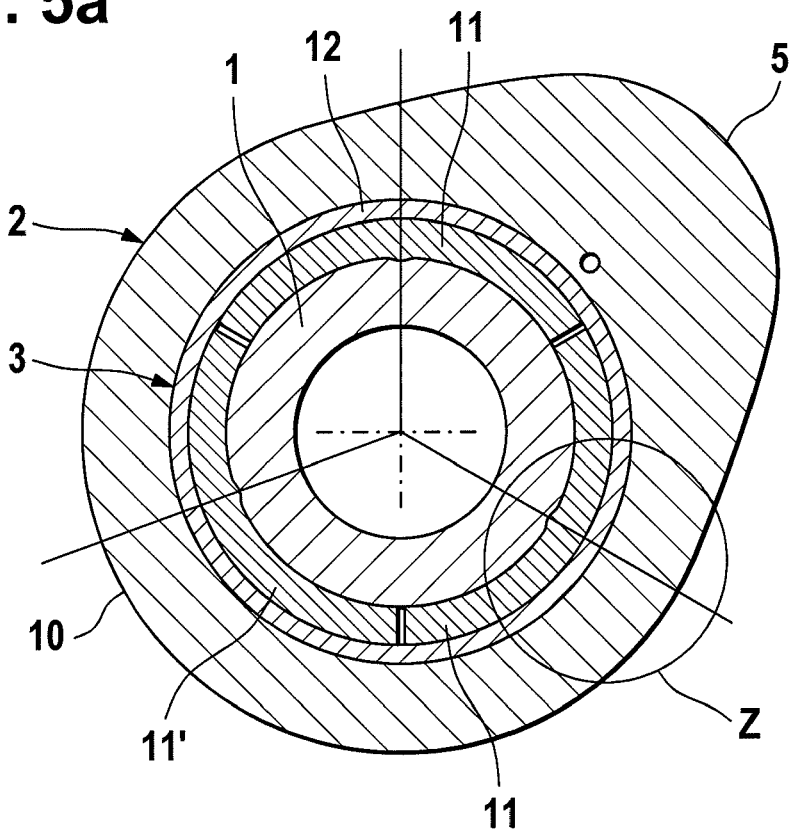
FIG. 5*a* is a cross-sectional view of a camshaft with the cam and the locking device.
Figure 5B:
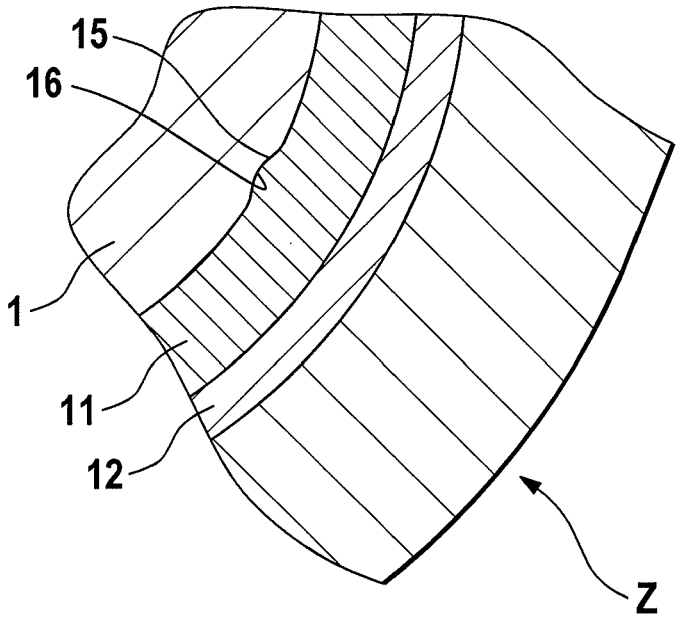
FIG. 5*b* is a detail Z from FIG. 5*a* in cutaway.

Furthermore, each locking shoe 11 has a projection 15 that projects inwardly in the radial direction. For holding these projections there are counter pockets 16 cut out on the camshaft 1. The ring 21 formed by the three separate locking shoes 11, 11' is oriented uniquely relative to the camshaft 1 by an asymmetric angular position of the projections 15. This can be clearly seen in FIGS. 5*a* and 5*b.* While two locking shoes 11 are identical, wherein each projection 15 lies on the bisecting line of an angle of the circular segment, the projection 15 of the third locking shoe 11' is displaced far from the bisecting line of the angle. The enlarged cutout according to FIG. 5*b* illustrates the shaping of the projections 15 and the positive-fit pockets 16 matching these projections as sections curved slightly outwardly or inwardly.

The locking collar 12 is formed from a cylindrical base part 17 and an axial shoulder part 18 of smaller diameter advantageously in one piece, wherein the inner diameter of the shoulder piece 18 expands in the radial direction toward the locking shoes 11, 11', so that a conical inner wall 19 is formed. The locking shoes 11, 11' have corresponding conical outer surfaces 20 tapering in the direction toward the locking collar 12, so that the outer periphery of the ring 21 and the inner periphery 19 of the shoulder part 18 form corresponding ramp-shaped boundary surfaces.

The base part 17 has a restoring spring 23 formed as a helical compression spring. For supporting the restoring spring 23, on the base part 17 of the locking collar 12, an inner shoulder 22 is formed as a stop for an end winding of the restoring spring 23 on the side facing away from the locking ring 21. As a stop for the other end winding of the restoring spring 23, a retaining ring 24 is provided that can be fixed in a groove 25 on the inner wall of the cam (see FIGS. 6*a*, 6*b*). For axial securing of the cam 2, a securing ring 26 is provided that sits in a securing groove 27 on the side of the cam 2 facing away from the locking device 3 in the camshaft 1.

The functioning of the cam locking will be explained below with reference to FIGS. 6*a* and 6*b:*

Figure 6A:
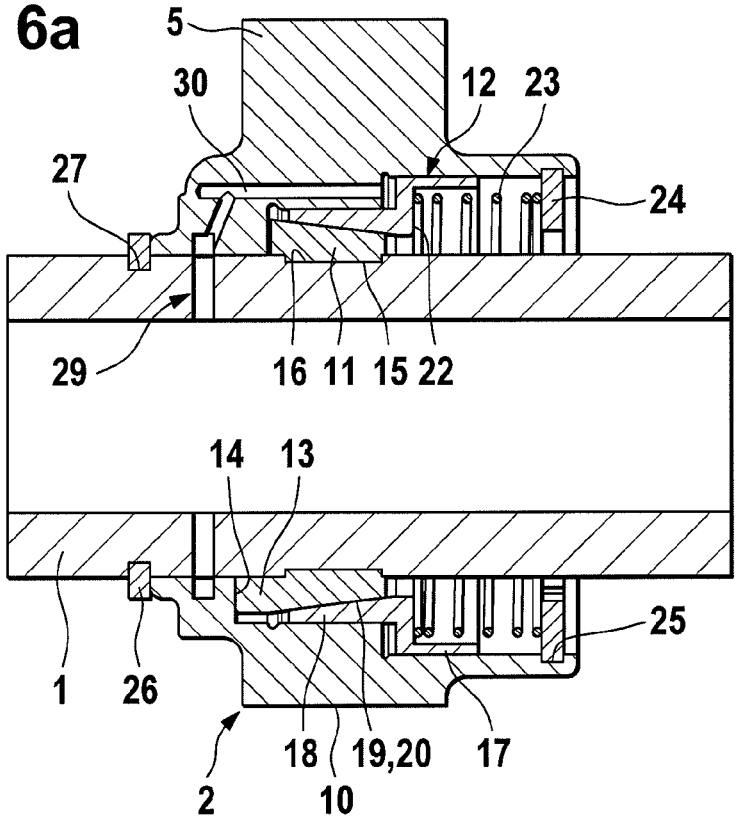
FIG. 6*a* is a longitudinal section view of the cam according to the invention in the locked state.

In FIG. 6*a*, the cam 2 is located in its locked state. Here, the locking collar 12 is pressed by the force of the restoring spring 23 against the locking shoes 11, 11' or the ring 21 forming the shoes. Through the ramp-shaped boundary surfaces 19, 20, a spring force component acts inward in the radial direction on the projections 15, so that these engage with the pockets 16.

Figure 6B:
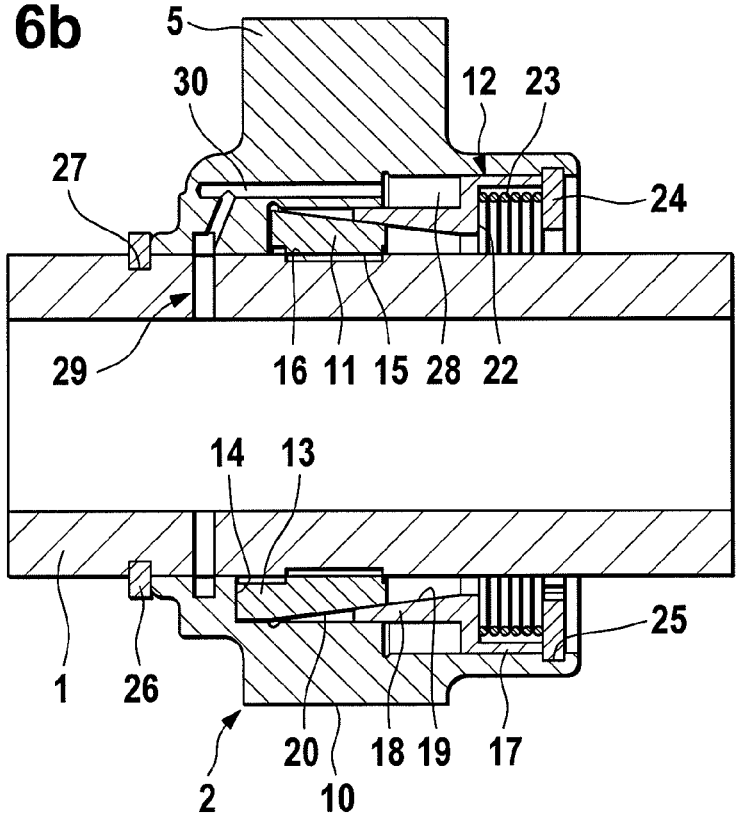
FIG. 6*b* is a longitudinal section view of the cam according to the invention in an unlocked state.

FIG. 6*b* shows the cam 2 in its unlocked state. For unlocking, hydraulic activation is provided. The locking collar 12 defines, on the inside of the cam, an annular pressure chamber 28. The pressure chamber 28 connects to a pressurized medium supply 29 that runs to the pressure chamber 28 via the camshaft 1 formed as a hollow shaft and connection channels 30. The pressure chamber 28 is loaded with pressurized oil for releasing the rotationally fixed connection between the camshaft 1 and the cam 2. The building oil pressure acts against the spring force of the restoring spring 23, so that the locking collar 12 releases from the locking shoes 11 as soon as the spring force is overcome. Here, the projections 15 of the locking shoes 11, 11' are pulled back from the locking pockets 16 of the camshaft, while the locking shoes 11, 11' themselves are further coupled to the cam 2 via the crenellations 13. Therefore, the rotationally fixed connection between the cam 2 and the camshaft 1 is released, so that the rotating camshaft 1 rotates under the cam 2 as soon as its cam raised section 5 reaches the contact roller 6 of the roller finger lever 4.

For new locking, the oil pressure in the pressure chamber 28 is released, whereupon the restoring force 23 presses the locking collar 12 against the locking shoes 11. The projections 15 are here loaded inward in the radial direction and engage with the locking pockets 16 of the camshaft 1 again as soon as the cam 2 reaches, relative to the camshaft 1, the orientation fixed by the asymmetric angular position (FIG. 5*a*) of the projections 15 and pockets 16.

LIST OF REFERENCE SYMBOLS

1 Camshaft
2 Cam

3 Locking device
4 Cam follower
5 Cam raised section
6 Cam contact roller
7 Spherical cap
8 Support element
9 Contact surface
10 Cam reference circle
11, 11' Locking shoe
12 Locking collar
13 Crenellation
14 Recess
15 Projection
16 Pocket
17 Base part
18 Shoulder part
19 Boundary surface
20 Boundary surface
21 Locking ring
22 Stop
23 Restoring spring
24 Stop
25 Groove
26 Securing ring
27 Groove
28 Pressure chamber
29 Pressurized means supply
30 Connection channel

The invention claimed is:

1. A valve train of an internal combustion engine comprising at least one camshaft on which at least one rotatable cam is arranged fixed in an axial direction, a rotationally locked connection of the at least one cam with the camshaft can be selectively established and released by an associated coupling locking device, the locking device is held within the cam and has a spring-loaded, annular locking collar movable in the axial direction on the camshaft and, as a counter part to the locking collar, locking shoes coupled with the cam, wherein, in a locking position, the locking collar is pressed against the locking shoes by contacting, ramp-shaped boundary surfaces formed on the locking collar and the locking shoes, so that radial projections arranged in the locking shoes engage in adjacent pocket-shaped receptacles of the camshaft by a radial force and, in an unlocked position, the locking collar is released from the locking shoes by a force acting against the radial force.

2. The valve train according to claim 1, wherein for unlocking, hydraulic activation is provided, wherein the locking collar defines an annular pressure chamber that can be loaded hydraulically with a pressurized medium pressure by a pressurized medium supply extending in the camshaft acting in an unlocking direction.

3. The valve train according to claim 2, wherein for controlling a hydraulic pressure a solenoid control valve is provided that can be switched between a low pressure that holds a certain pressurized medium level in the pressurized medium supply in the locking position and a switching pressure that delivers an engine oil pressure generated by a pressurized medium pump.

4. The valve train according to claim 1, wherein the locking collar is activated electrically for an adjustment movement.

5. The valve train according to claim 1, wherein there are three of the locking shoes, each with at least one locking projection, which form an annular arrangement, and the locking projections are arranged at an asymmetric angular position relative to each other.

6. The valve train according to claim 1, wherein the cam is secured in an axial direction by a securing ring located in a groove on the camshaft.

7. The valve train according to claim 1, wherein the coupling of the locking shoes with the cam is formed by crenellation projections on the locking shoes, and the crenellation projections correspond and interact with crenellation-like recesses on an inside of the cam.

8. The valve train according to claim 1, wherein, on the locking collar, on an end facing away from the locking shoes, a restoring spring formed as a cylindrical helical compression spring acts with a spring force that is supported between a stop on the locking collar and a stop on the cam.

9. The valve train according to claim 8, wherein the locking collar-side stop is formed as a shoulder part connected integrally to the locking collar.

10. The valve train according to claim 8, wherein the cam-side stop is formed as a retaining ring supported on the inside of the cam.

11. The valve train according to claim 1, wherein a plurality of the projections are arranged for each of the locking shoes and accordingly a plurality of the locking pockets are arranged on the camshaft corresponding to the locking shoes.

12. The valve train according to claim 1, wherein the locking shoes are embossed or cold-formed from metal.

13. The valve train according to claim 1, wherein the at least one cam is a powdered-metallurgical part.

14. The valve train according to claim 1, wherein the locking collar is a deep-drawn part.

15. The valve train according to claim 1, wherein mechanically loaded components of the locking device are produced from wear-resistant steel or are provided with wear-resistant surfaces.

* * * * *